US008525754B2

(12) United States Patent
Sumiyoshi

(10) Patent No.: US 8,525,754 B2
(45) Date of Patent: Sep. 3, 2013

(54) DISPLAY DEVICE WITH LENS ARRAY OR PARALLAX BARRIER THAT SWITCHES BETWEEN NARROW VIEW MODE AND WIDE VIEW MODE

(75) Inventor: Ken Sumiyoshi, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 955 days.

(21) Appl. No.: 11/850,435

(22) Filed: Sep. 5, 2007

(65) Prior Publication Data

US 2008/0074347 A1 Mar. 27, 2008

(30) Foreign Application Priority Data

Sep. 26, 2006 (JP) ..... 2006-260337

(51) Int. Cl.
*G09G 5/00* (2006.01)

(52) U.S. Cl.
USPC ..... 345/4; 348/42; 359/462

(58) Field of Classification Search
USPC ..... 345/4–6, 204, 87, 695; 359/462–477; 349/15; 353/7; 348/42; 726/1–32
See application file for complete search history.

(56) References Cited

U.S. PATENT DOCUMENTS 5,612,709 A * 3/1997 Sudo et al. ..... 345/8
7,199,845 B2 4/2007 Koyama et al.
7,250,923 B2 7/2007 Taira et al.
2005/0111100 A1* 5/2005 Mather et al. ..... 359/464
2005/0200781 A1* 9/2005 Takatani ..... 349/122
2005/0243265 A1* 11/2005 Winlow et al. ..... 349/178
2007/0040780 A1* 2/2007 Gass et al. ..... 345/87
2009/0102990 A1* 4/2009 Walton et al. ..... 349/15

FOREIGN PATENT DOCUMENTS

CN 1525243 A 9/2004
CN 1685277 A 10/2005
JP 6-105305 A 4/1994
JP 2006-163413 A 6/2006

* cited by examiner

*Primary Examiner* — Liliana Cerullo
(74) *Attorney, Agent, or Firm* — Sughrue Mion, PLLC

(57) ABSTRACT

A display device includes a display panel including a plurality of pixel groups for displaying respective images independently of each other, and a parallax barrier for limiting view ranges of images displayed respectively by the pixel groups such that the view ranges overlap each other in an overlap area. The display device is selectively operable in a first display mode in which a significant image is recognizable when images displayed respectively by the pixel groups are simultaneously observed in the overlap area, and in which a significant image is unrecognizable when the images displayed respectively by the pixel groups are observed individually in the view ranges except for the overlap area, respectively, and a second display mode in which a significant image is recognizable both when the images displayed respectively by the pixel groups are simultaneously observed in the overlap area and when the images displayed respectively by the pixel groups are observed individually in the view ranges except for the overlap area, respectively.

17 Claims, 10 Drawing Sheets

DISPLAY DEVICE WITH LENS ARRAY OR PARALLAX BARRIER THAT SWITCHES BETWEEN NARROW VIEW MODE AND WIDE VIEW MODE

BACKGROUND OF THE INVENTION

1. Field of the Invention

The present invention relates to a display device, and more particularly to a display device which is capable of changing a view angle range.

2. Description of the Related Art

With the development of display technology in recent years, display devices that can be viewed in a wide angle range have been put to practical use. Portable information terminals incorporating display devices such as liquid crystal displays have also been in widespread use. If the information displayed on a portable information terminal is to be viewed by a plurality of people, then it is desirable that the information be visible in a wide angle. On the other hand, there is a situation where the displayed information should not be viewed by other people. Consequently, there is a demand for display devices capable of switching between a wide view angle range and a narrow view angle range for viewing the information displayed on the display screen depending on the way in which the display device is used.

One example of display device which can meet the above demand is disclosed in JP06-105305A. The disclosed display device will be described below with reference to FIG. 1 of the accompanying drawings. FIG. 1 is a view of the display device disclosed in the above publication, the display device being relevant to the present invention.

As shown in FIG. 1, the display device has liquid crystal display 101 with lenticular lens plate 102 mounted thereon. On the average, each lens of lenticular lens plate 102 is associated with two pixels. In particular, pixel 103 is disposed at the center of each lens, and pixel 104 is disposed at an end thereof.

For the display device to display an image in a narrow view range, the display device supplies only pixels 103 with a display signal. At this time, the displayed image can be viewed only in view range 105. For the display device to display an image in a wide view range, the display device simultaneously supplies pixels 103, 104 with a display signal. At this time, the displayed image can be viewed not only in view range 105, but also in view ranges 106, 107.

As described above, the display device disclosed in JP-A No. 6-105305 allows different view ranges to be selected by controlling the supply of display signals to pixels 103, 104.

However, the disclosed display device suffers the following difficulties:

Firstly, the size of view range 105 is determined by the size of pixel 103. Therefore, if the view range is to be set to a narrow range, then the size of pixel 103 needs to be reduced, and the display device displays images with a low luminance level, i.e., dark images.

Secondly, there is a non-display area created between view range 105 and view range 106 or 107 because the gap between pixels 103, 104 is magnified by the lens. As a result, the viewer sees dark lines in the displayed image, and feels awkward about the displayed image. The darks lines are caused when both pixels 103, 104 are displayed in order to display an image in a wide view angle. As the viewer has to attempt to view the image while avoiding the dark lines, the display device, in practice, fails to provide wide view angles.

SUMMARY OF THE INVENTION

It is an exemplary object of the present invention to provide a display device which is capable of preventing the luminance of a displayed image from being lowered when the display device displays an image in a narrow view range, and which is capable of preventing non-display areas (dark areas) from being created when the display device displays an image in a wide view range.

According to an exemplary aspect of the present invention, a display device includes a display panel including a plurality of pixel groups for displaying respective images independently of each other, and a parallax barrier for limiting view ranges of images displayed respectively by the pixel groups such that the view ranges overlap each other in an overlap area. The display device is selectively operable in a first display mode in which a significant image is recognizable when images displayed respectively by the pixel groups are simultaneously observed in the overlap area, and a significant image is unrecognizable when the images displayed respectively by the pixel groups are observed individually in the view ranges except for the overlap area, respectively, and a second display mode in which a significant image is recognizable both when the images displayed respectively by the pixel groups are simultaneously observed in the overlap area and when the images displayed respectively by the pixel groups are observed individually in the view ranges except for the overlap area, respectively.

DESCRIPTION OF THE EXEMPLARY EMBODIMENTS

Figure 1:
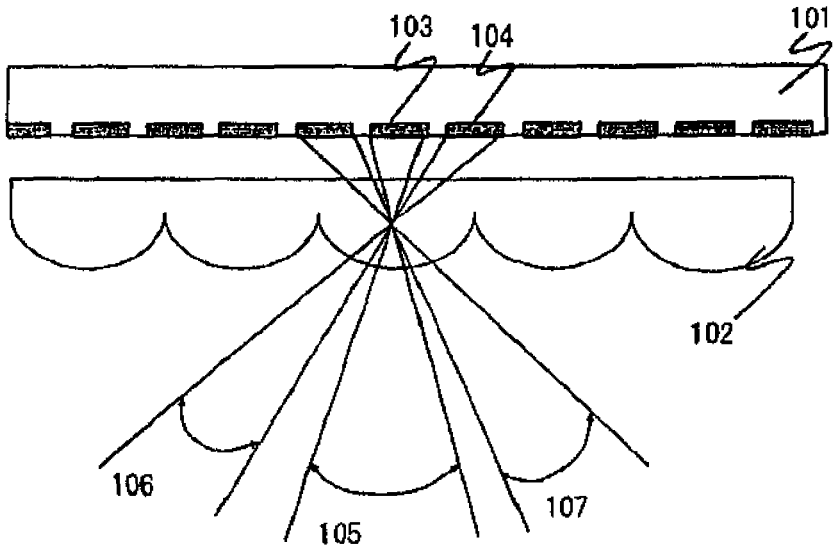
Fig. 1 (Related Art)
FIG. 1 is a schematic cross-sectional view of a display device according to the related art.
Figure 2:
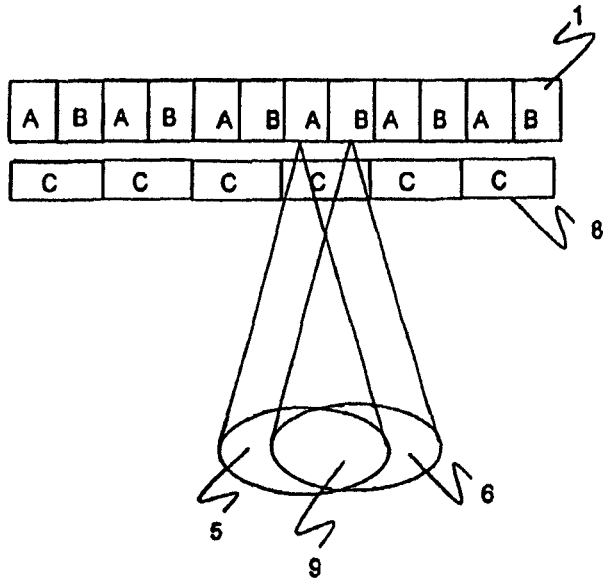
FIG. 2 is a schematic view showing a conceptual arrangement of a display device according to an exemplary embodiment of the present invention.

FIG. 2 is a schematic view showing a conceptual arrangement of a display device according to an exemplary embodiment of the present invention.

As shown in FIG. 2, the display device according to the exemplary embodiment of the present invention includes display panel 1 and multiple pie viewpoint activator 8. Display panel 1 comprises a plurality of pixel groups. In FIG. 2, display panel 1 comprises an alternate array of two pixel groups, i.e., pixel groups A, B, for example. Multiple viewpoint activator 8 includes a repetitive pattern of units C corresponding to the pixel groups A, B. Each of pixel groups A can be viewed in view range 5 through multiple viewpoint activator 8. Each of pixel groups B can be viewed in view range 6 through multiple viewpoint activator 8. In the present exemplary embodiment, view ranges 5, 6 overlap each other to provide overlap area 9 in space.

Figure 3:
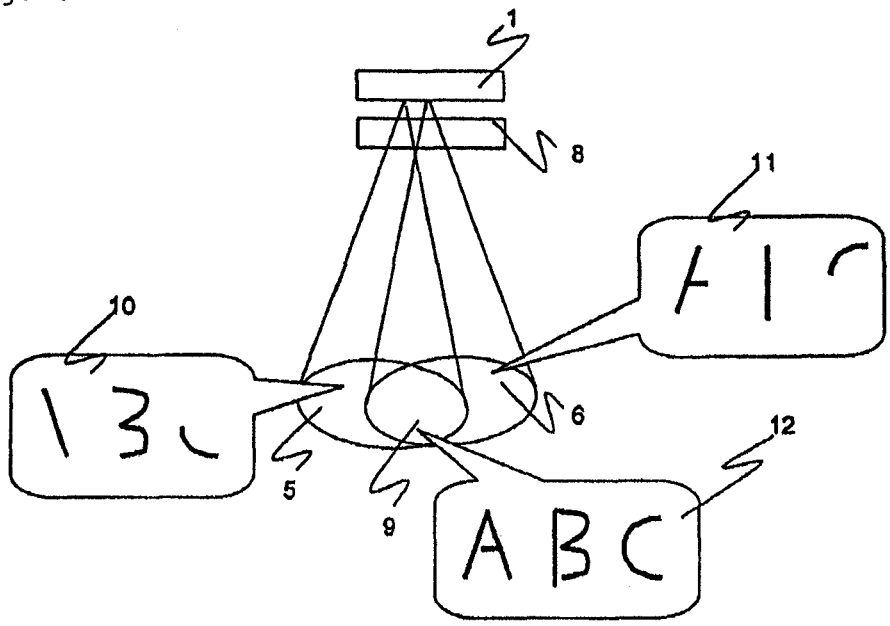
FIG. 3 is a schematic view illustrative of a display operation of the display device in a first display mode.

A display operation of the display device according to the exemplary embodiment will be described below with reference to FIGS. 3 and 4.

The display device has two display modes, i.e., a first display mode and a second display mode. FIG. 3 shows the display operation in the first display mode. In view range 5 corresponding to pixel group A, the viewer can view a displayed image shown in display content 10, for example. In view range 6 corresponding to pixel group B, the viewer can view a displayed image shown in display content 11, for example. These display contents 10, 11 have no significance themselves, which the viewer is unable to understand. In overlap area 9 where view ranges 5, 6 overlap each other, the viewer can view a displayed image shown in display content 12. Display content 12 has significance based on the combination of display contents 10, 11, which the viewer is able to understand. The display device thus allows the viewer to recognize a significant image by simultaneously observing the images displayed by the pixel images A, B in overlap area 9 of view ranges 5, 6.

Figure 4:
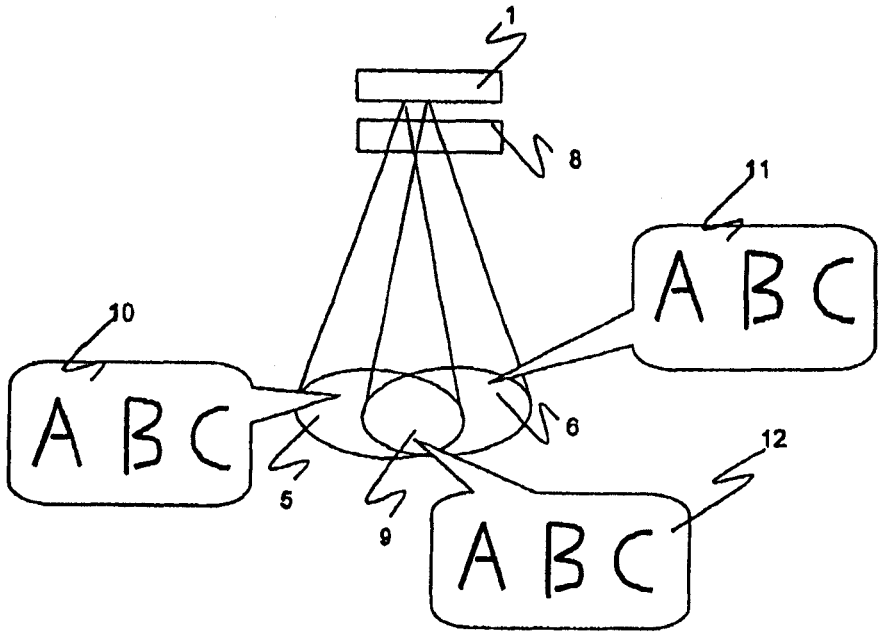
FIG. 4 is a schematic view illustrative of a display operation of the display device in a second display mode.

FIG. 4 shows the display operation in the second display mode. In the second display mode, the display device allows the viewer to recognize significant images by observing the images displayed by the pixel images A, B in respective view ranges 5, 6.

The display device can switch between the first display mode and the second display mode by changing display signals to be displayed by pixel groups A, B. In the first display mode, the display device controls pixel group A to display the image in view content 10 shown in FIG. 3 and controls pixel group B to display the image in view content 11 shown in FIG. 3, thereby displaying the image in overlap area 12 shown in FIG. 3. Specifically, pixel group A displays the image in view content 10 which is part of the significant image and pixel group B displays the image in view content 11 which is part of the significant image. The image displayed in view content 10 and the image displayed in view content 11 are combined with each other to display the significant image in overlap area 9.

In the second display mode, the display device controls pixel group A to display the significant image in view content 10 shown in FIG. 4 and controls pixel group B to display the significant image in view content 11 shown in FIG. 4, thereby displaying the image in overlap area 12 shown in FIG. 4. The significant image is also displayed in overlap area 9 shown in FIG. 4.

Figure 5:
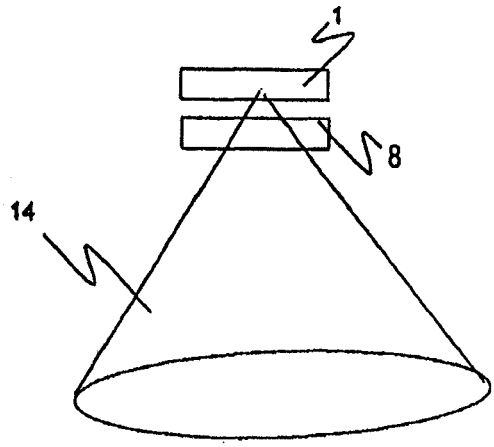
FIG. 5 is a schematic view showing a view range at the time the display device switches to the second display mode and brings a multiple viewpoint activator into an inactive state.

If multiple viewpoint activator 8 is controllable to switch between an active state and an inactive state, then it can be used in combination with the first and second display modes. For example, if the display device is in the first display mode and brings multiple viewpoint activator 8 into the active state, the display device displays the images shown in FIG. 3. If the display device switches to the second display mode and brings multiple viewpoint activator 8 into the inactive state, then the display device displays an image shown in FIG. 5. Since multiple viewpoint activator 8 is in the inactive state, the display device provides single large view range 14. Therefore, the viewer can recognize the displayed image without being conscious of the presence of multiple viewpoint activator 8.

Multiple viewpoint activator 8 may comprise a parallax barrier or a lens array. If multiple viewpoint activator 8 has repetitive parallax barrier units or lenses arrayed in one direction across display panel 1, then it provides a plurality of viewpoints along the direction of the array of repetitive parallax barrier units or lenses. For example, if repetitive parallax barrier units or lenses of multiple viewpoint activator 8 are arrayed in a horizontal direction across display panel 1, then multiple viewpoint activator 8 provides a plurality of viewpoints along the horizontal direction. If multiple viewpoint activator 8 comprises repetitive parallax barrier units or lenses arrayed in two directions transverse to each other, e.g., a vertical direction and a horizontal direction, then multiple viewpoint activator 8 provides a plurality of viewpoints along each of the vertical and horizontal directions.

More specifically, multiple viewpoint activator 8 may comprise an array of voltage-variable lenses, i.e., an array of liquid-crystal lenses. The liquid-crystal lenses comprise liquid crystal cells each for performing a lens function when a voltage is applied thereto. Alternatively, multiple viewpoint activator 8 may comprise an array of variable lenses incorporating liquids. Each of the variable lenses comprises a cell combined with electrodes and filled with two liquid layers. When a voltage is applied between the electrodes, they generate an electric field which deforms the interface between the liquid layers. The interface between the liquid layers is deformed only when the voltage is applied between the electrodes. The lens function of each of the variable lenses is turned on and off by turning on and off the interface deformation with the electric field.

If multiple viewpoint activator 8 comprises an array of repetitive parallax barrier units in one direction or two directions, then multiple viewpoint activator 8 may be constructed of a liquid crystal layer and a repetitive array of voltage supplies. For example, multiple viewpoint activator 8 may include a twisted nematic liquid crystal layer inserted between a pair of orthogonal polarizers and combined with a repetitive array of voltage supplies. The twisted nematic liquid crystal layer operates in a normally white mode. When a voltage is periodically applied to the twisted nematic liquid crystal layer, it functions as a parallax barrier unit. When the voltage stops being applied to the twisted nematic liquid crystal layer, the parallax barrier units are brought into the inactive state.

If an array of lenses is used as multiple viewpoint activator 8, then the layout of the pixel groups is changed to provide overlap areas of the view ranges, as described below with reference to FIG. 6.

Figure 6:
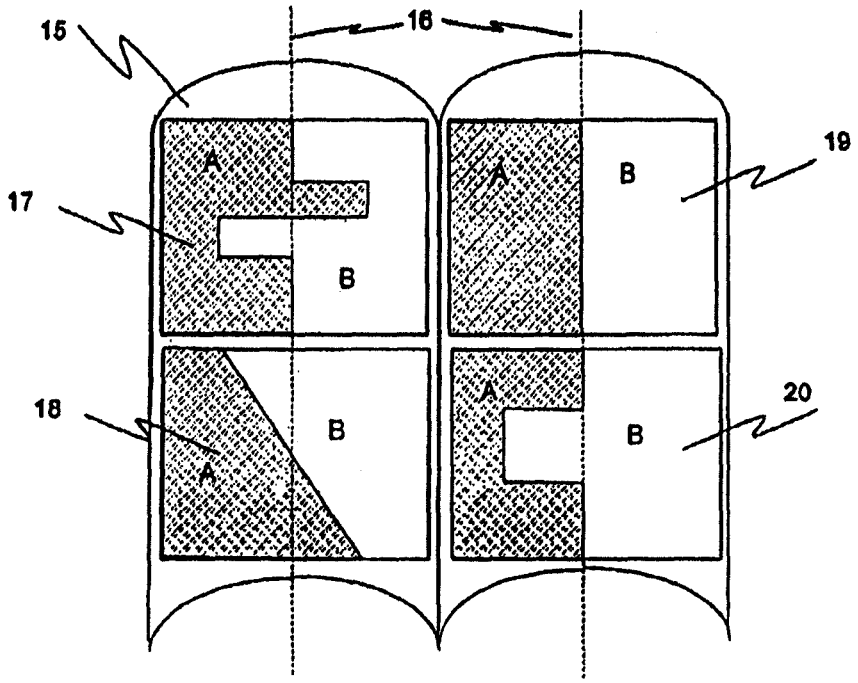
FIG. 6 is a transparent plan view of a structure comprising a lenticular lens array and two pixel groups.

FIG. 6 shows in transparent plan a structure comprising a lenticular lens array and two pixel groups. As shown in FIG.

6, lenticular lens array 15 is of a horizontally repetitive structure. Two pixel groups A, B of the display panel are of four different shapes in respective pixel layouts 17, 18, 19, 20 each.

According to pixel layout 19, the pixels of pixel group A and the pixels of pixel group B are separated from each other by central line 16 of the lenticular lens. Pixel layout 19 does not provide an overlap area between the view range of pixel groups A, B.

According to pixel layouts 17, 18, the pixels of pixel group A and the pixels of pixel group B are arranged in intricate patterns extending across central line 16 of the lenticular lens. In the view range provided by the left half of the lenticular lens, an image is displayed mainly by pixel group A, and is combined with certain image information from pixel group B. In the view range provided by the right half of the lenticular lens, an image is displayed mainly by pixel group B, and is combined with certain image information from pixel group A. Accordingly, pixel layouts 17, 18 provide a view range where the image displayed by pixel group A and the image displayed by pixel group B are combined with each other.

According to pixel layout 20, in the view range provided by the left half of the lenticular lens, an image is displayed mainly by pixel group A, combined with certain image information from pixel group B.

By thus changing the pixel layouts, the shapes of the view ranges provided by the pixel groups can be changed to provide intricate view ranges. Since the intricate view ranges are of complex spatial shapes, they can be virtually regarded as overlap areas of the view ranges. In this manner, overlap areas of the view ranges can be produced when a lens array is used as multiple viewpoint activator 8.

Figure 7:
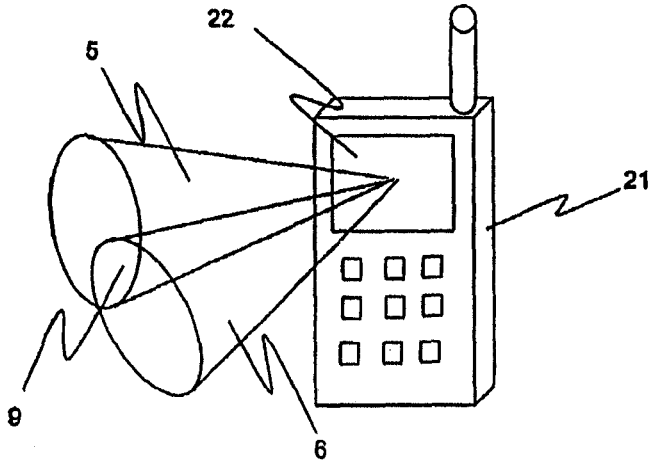
FIG. 7 is a schematic perspective view of a specific display device according to the exemplary embodiment of the present invention.

The display device according to the exemplary embodiment of the present invention may be incorporated in an electronic device. FIG. 7 shows in schematic perspective display device 22 according to the exemplary embodiment which is incorporated in mobile phone unit 21. In FIG. 7, two view ranges 5, 6 are produced by display device 22 and a multiple viewpoint activator, not shown. In the first display mode, the viewer can recognize a significant image only in overlap area 9 of view ranges 5, 6. Mobile phone unit 21 includes a controller, not shown, for controlling display device 22 to switch between the first display mode and the second display mode in response to a certain control key action. When display device 22 is controlled to switch to the second display mode, the viewer can observe the same displayed image in view ranges 5, 6. If the viewer does not want other people to see the displayed image on display device 22, then the viewer controls display device 22 to display an image in the first display mode, so that the significant image can be recognized only in overlap area 9. As a consequence, the image information displayed on display device 22 is made snooper-proof and hence highly confidential.

With the display device according to the exemplary embodiment, the size of the overlap area where the view ranges overlap each other in the first display mode does not depend on the size of the pixels. Therefore, the luminance of images displayed in the first display mode having the relatively narrow view range is maintained at a desired level. Furthermore, since the display device according to the exemplary embodiment provides the overlap area where the view ranges overlap each other, no non-display area (dark area) is created in the second display mode that has the relatively wide view range, thereby allowing the viewer to view images in a wide view range. Consequently, the display device according to the exemplary embodiment prevents the luminance of the displayed image from being lowered when an image is displayed in a narrow view angle, and also prevents a non-display area (dark area) from being created when an image is displayed in a wide view angle.

Display devices according various examples of the present invention will be described below.

1st Example

A display device according to a first example of the present invention will be described below with reference to FIGS. 8 through 11.

Figure 8:
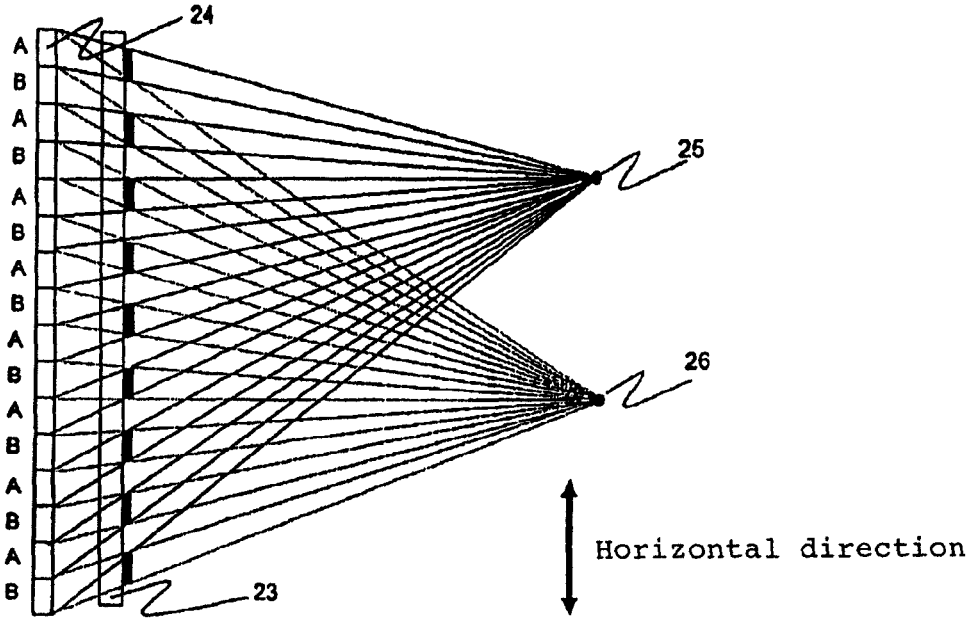
FIG. 8 is a view illustrative of the display device according to a first example of the present invention.

As shown in FIG. 8, the display device according to the first example comprises display panel 24 and parallax barrier 23 disposed on display panel 24. Parallax barrier 23 serves as a multiple viewpoint activating means. Display panel 24 may comprise a liquid crystal display panel or a light emission display panel. Parallax barrier 24 comprises an alternate array of light-impermeable strips and light-permeable strips which are arranged such that each of the strips is oriented in the vertical direction of display panel 24.

Display panel 24 comprises a plurality of pixel groups of two types, i.e., pixel groups A, B. Pixel groups A and Pixel groups B are alternately arranged in an array along the horizontal direction of display panel 24. The layout of both pixel groups A, B is illustrated in FIG. 8. As shown in FIG. 8, only an image displayed by pixel groups B can be observed through parallax barrier 23 from viewpoint 25, and only an image displayed by pixel groups A can be observed through parallax barrier 23 from viewpoint 26. Therefore, the display device according to the first example provides a plurality of view ranges through parallax barrier 23 serving as the multiple viewpoint activating means.

Figure 9:
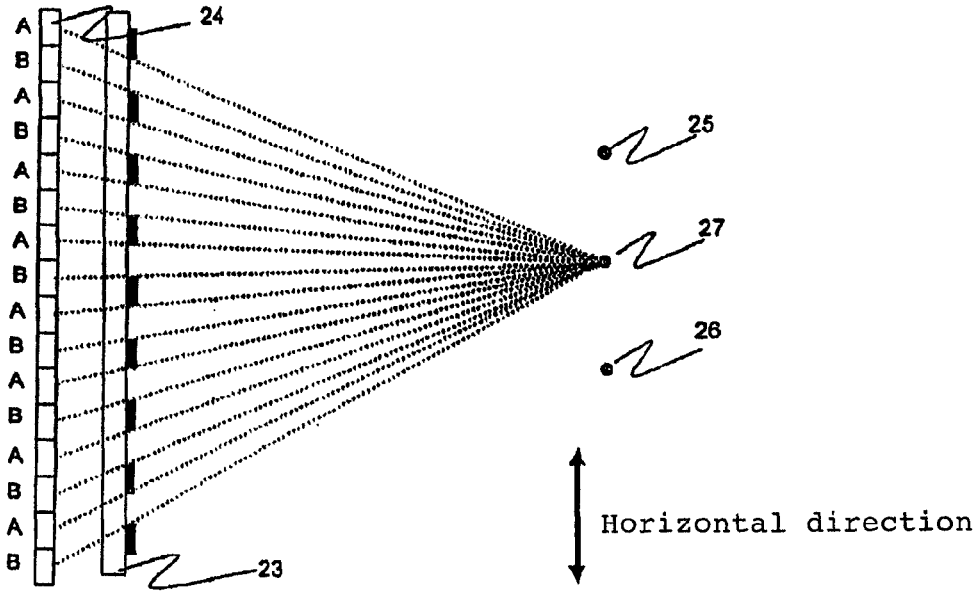
FIG. 9 is a view illustrative of the display device according to the first example of the present invention.

As shown in FIG. 9, both the image displayed by pixel groups A and the image displayed by pixel groups B can simultaneously be observed from viewpoint 27 which is positioned intermediate between viewpoints 25, 26. The view ranges provided by the display device thus have an overlap area with viewpoint 27 being disposed at the center of the overlap area.

Figure 10:
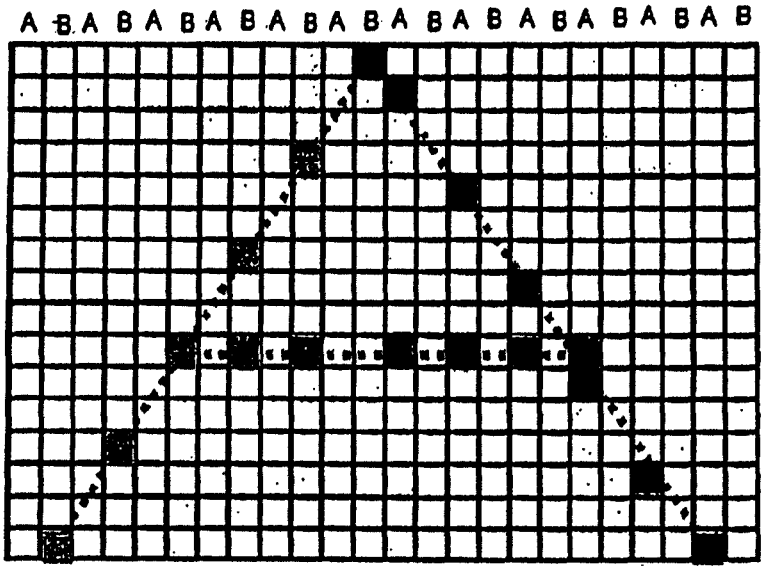
FIG. 10 is a view illustrative of the display device according to the first example of the present invention.

In the first display mode, display panel 24 displays an image shown in FIG. 10. Specifically, an image representing a left half of the letter "A" is displayed by pixel group B in the left half of the display screen shown in FIG. 10, and an image representing a right half of the letter "A" is displayed by pixel group A in the right half of the display screen shown in FIG. 10. Therefore, the images representing the left and right halves, respectively, of the letter "A" are observed from the viewpoints 25, 26, respectively, shown in FIG. 8. Since the image displayed by pixel groups A and the image displayed by pixel groups B can simultaneously be observed from viewpoint 27 shown in FIG. 9, the entire image of the letter "A" is observed from viewpoint 27. The viewer can recognize the displayed image as a significant image only when observing the image from viewpoint 27.

Figure 11:
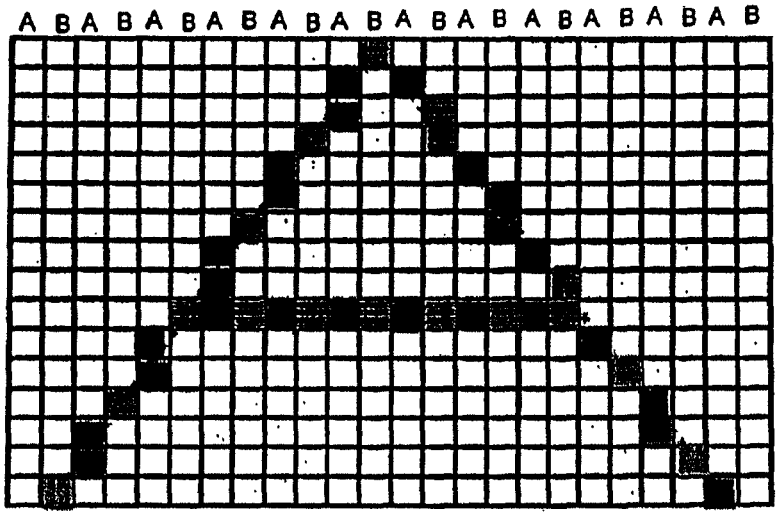
FIG. 11 is a view illustrative of the display device according to the first example of the present invention.

If the image information supplied to pixel groups A, B is changed and the display device switches to the second display mode, then an image shown in FIG. 11 is displayed on display panel 24. In the second display mode, both image groups A, B display the entire image of the letter "A" fully on the display screen. Therefore, the viewer can recognize the displayed image of the letter "A" on the display screen from both viewpoints 25, 26 shown in FIG. 8, and can also recognize the displayed image of the letter "A" on the display screen from viewpoint 27 shown in FIG. 9.

2nd Example

Figure 12:
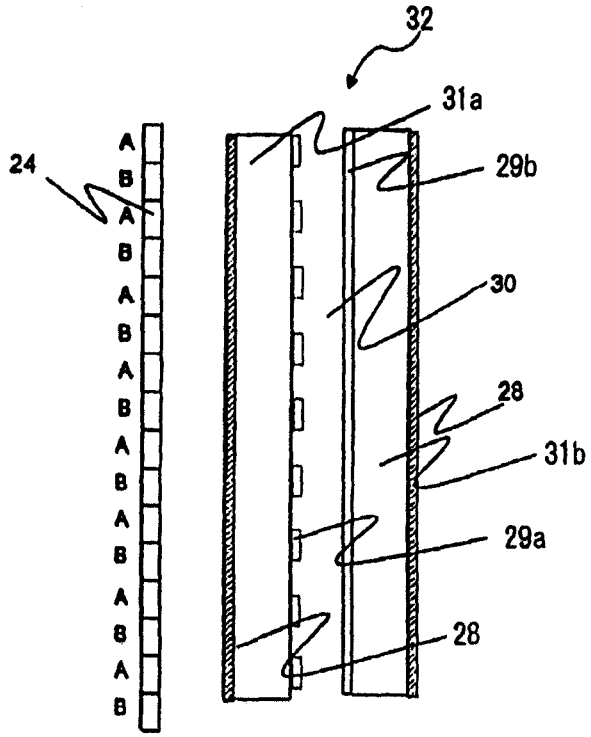
FIG. 12 is a cross-sectional view of a display device according to a second example of the present invention.

A display device according to a second example of the present invention will be described below with reference to FIGS. 12 and 13.

The display device according to the second example includes liquid crystal device 32 as a multiple viewpoint activating means. As shown in FIG. 12, the display device comprises display panel 24 and a parallax barrier disposed in front of display panel 24 and comprising liquid crystal device 32.

The parallax barrier in the form of liquid crystal device 32 comprises first substrate 31*a* positioned opposite display panel 24 and second substrate 31*b* positioned opposite first substrate 31*a*. Each of first and second substrates 31*a*, 31*b* is made of glass or plastic. Polarizer 28 is mounted on the surface of first substrate 31*a* which faces display panel 24. Another polarizer 28 is mounted on the surface of second substrate 31*b* which is remote from first substrate 31*a*. First transparent electrode 29*a* is mounted on the surface of first substrate 31*a* which faces second substrate 31*b*. Second transparent electrode 29*b* is mounted on the surface of second substrate 31*b* which faces first substrate 31*a*. First transparent electrode 29*a* comprises a plurality of strips associated respectively with pixel groups A, B of display panel 24. Second transparent electrode 29*b* is disposed substantially fully over second substrate 31*b*. Liquid crystal layer 30 is disposed between first substrate 31*a* and second substrate 31*b*. Liquid crystal layer 30 can operate in a normally white liquid crystal mode.

By applying a voltage to striped transparent electrode 29*a* to bring liquid crystal device 32 into the active state, striped electrode 29*a* is turned into light-impermeable strips and light-permeable strips. Signals for displaying the images shown in FIG. 10 are supplied to pixel groups A, B to operate the display device in the first display mode.

When no voltage is applied to transparent electrode 29*a* to bring liquid crystal device 32 into the inactive state, since liquid crystal device 32 becomes transparent, it no longer functions as the parallax barrier. Signals for displaying the images shown in FIG. 11 are supplied to pixel groups A, B to operate the display device in the second display mode. Since no light-impermeable strips are produced, the transmittance of the liquid crystal device increases to increase the luminance of the displayed image.

The display device according to the second example should preferably be operated to change the display signals supplied to display panel 24 in synchronism with the switching between the display modes of liquid crystal device 32. A control system for changing the display signals supplied to display panel 24 in synchronism with the switching between the display modes of liquid crystal device 32 will be described below with reference to FIG. 13.

Figure 13:
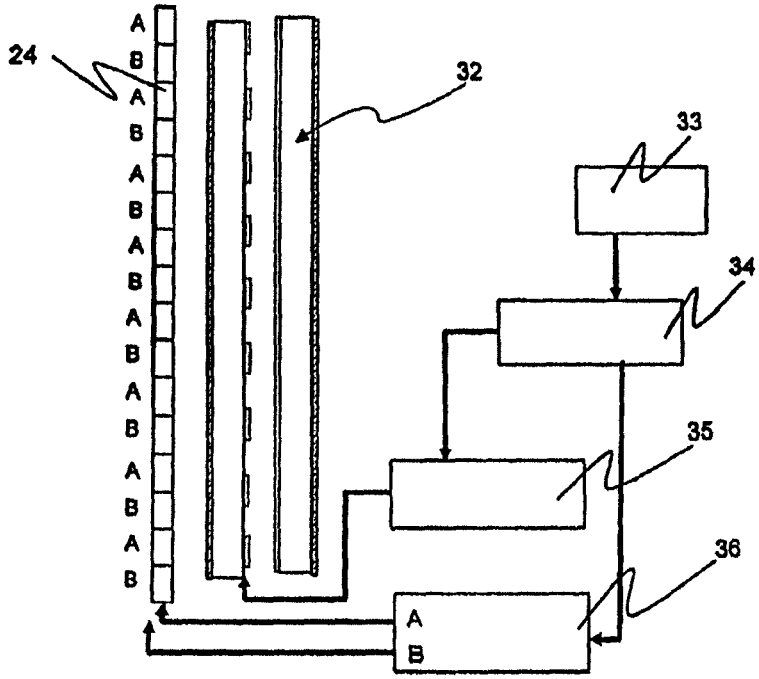
FIG. 13 is a cross-sectional view, partly in block form, of the display device according to the second example of the present invention.

As shown in FIG. 13, the display device includes display panel 24 and liquid crystal device 32 serving as the multiple viewpoint activating means. When the user operates keypad 33 to enter a display mode switching request signal, the display mode switching request signal is sent to device controller 34. Device controller 34 sends the display mode switching request signal to liquid crystal controller 35 and display signal processor 36. Liquid crystal controller 35 changes voltages applied to liquid crystal layer 30. At the same time, display signal processor 36 changes display signals applied to pixel groups A, B. In this manner, the display signals supplied to display panel 24 are changed in synchronism with the switching between the display modes of liquid crystal device 32.

In FIG. 13, liquid crystal device 32 is disposed in front of display panel 24. However, display panel 24 may be disposed in front of liquid crystal device 32. With display panel 24 disposed in front of liquid crystal device 32, since display panel 24 directly faces the viewer, the viewer does not experience an unwanted reduction in the contrast due to light scattering and does not feel a so-called depth when viewing the displayed image.

3rd Example

Figure 14:
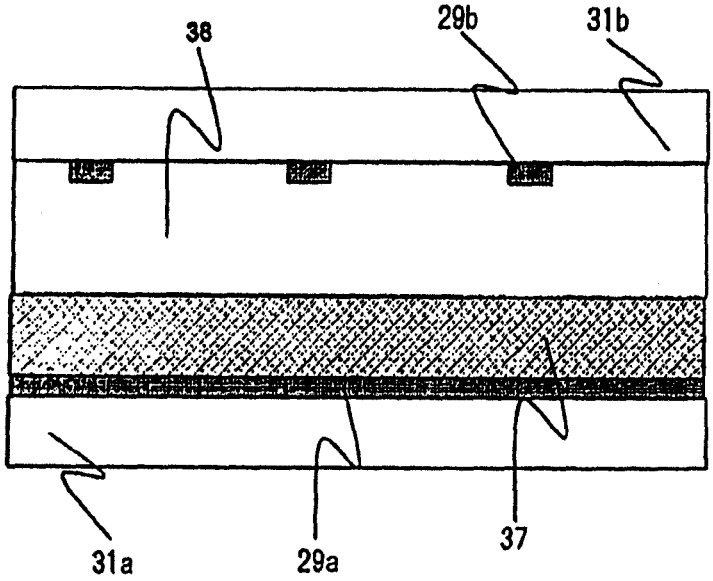
FIG. 14 is a cross-sectional view of a display device according to a third example of the present invention.

A display device according to a third example of the present invention will be described below with reference to FIGS. 14 through 16.

The display device according to the third example includes a voltage-controllable lens array device as a multiple viewpoint activator. As shown in FIG. 14, the voltage-controllable lens array device comprises first substrate 31*a* and second substrate 31*b* disposed opposite first substrate 31*a*. First transparent electrode 29*a* is mounted on the surface of first substrate 31*a* which faces second substrate 31*b*. Second transparent electrode 29*b* is mounted on the surface of second substrate 31*b* which faces first substrate 31*a*. First transparent electrode 29*a* is disposed substantially fully over first substrate 31*a*. Second transparent electrode 29*b* comprises a plurality of strips. Two liquid layers, i.e., first liquid 37 and second liquid 38, are sealed between first substrate 31*a* and second substrate 31*b*. Liquids 37, 38 are insoluble into each other, and have different specific gravities, different dielectric constants, and different refractive indexes. Therefore, first liquid 37 and second liquid 38 are separate as two different layers in the voltage-controllable lens array device.

Figure 15:
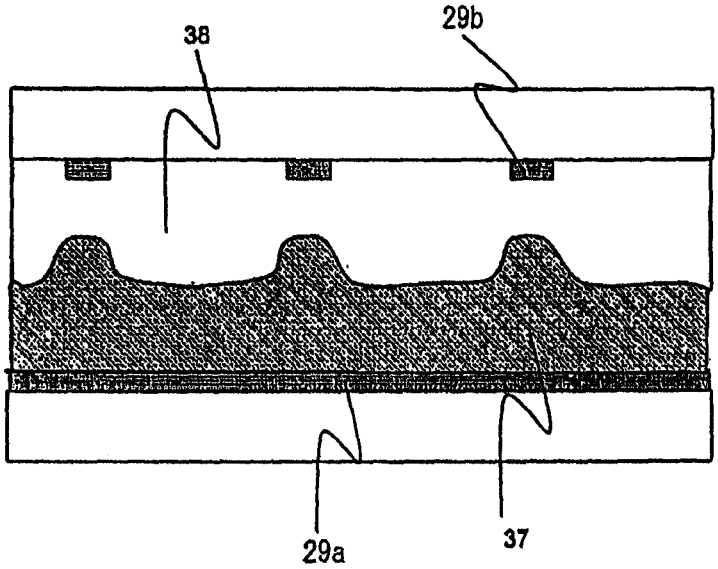
FIG. 15 is a cross-sectional view of the display device according to the third example of the present invention.
Figure 16:
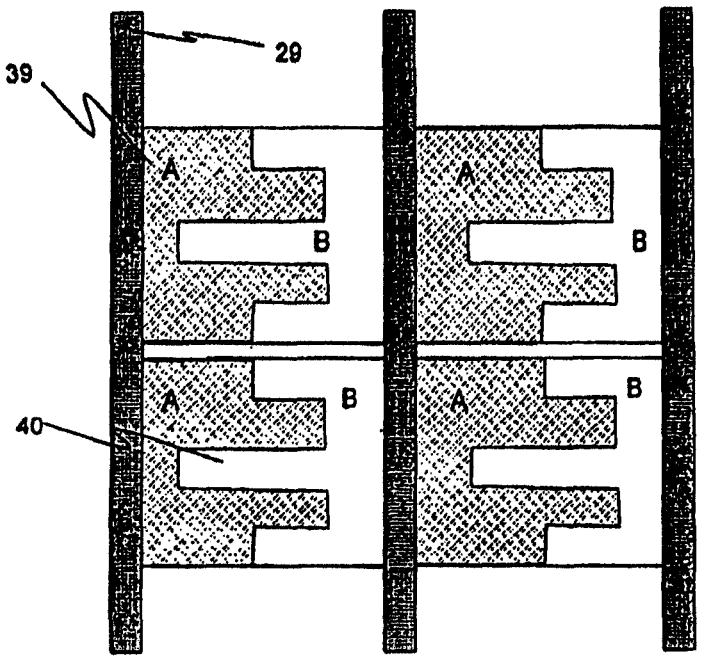
FIG. 16 is a plan view of the display device according to the third example of the present invention.

When a voltage is applied between first and second transparent electrodes 29*a*, 29*b*, the interface between the two layers of first liquid 37 and second liquid 38 is modulated as shown in FIG. 15 because first liquid 37 and second liquid 38 have different dielectric constants. The modulated interface functions as a lens. When no voltage is applied between first and second transparent electrodes 29*a*, 29*b*, the interface returns to the state shown in FIG. 14. The lens array device is thus controlled by the voltage applied between first and second transparent electrodes 29*a*, 29*b*.

The display device according to the third example which incorporates the lens array device described above will be described in detail below with reference to FIG. 16. The display device comprises a display panel and a voltage-controllable lens array device as the multiple viewpoint activator placed on the display panel. FIG. 16 is a transparent plan view that shows the display panel and the voltage-controllable lens array device. The display panel includes pixel groups A and pixel groups B, and the pixels of pixel group A and the pixels of pixel group B are arranged in intricate patterns extending across the central lines of the lenses to provide overlap areas of view ranges. Second transparent electrode 29*b* shown in FIG. 14 comprises a plurality of strips aligned with columns of the pixels of pixel groups A, B. When a voltage is applied to the lens array device to perform a lens function thereof, the display device produces view ranges corresponding to pixel groups 39 (A) and pixel groups 40 (B).

In the first display mode, a voltage is applied between transparent electrodes 29*a*, 29*b* to bring the lens array device into the active state, and the display panel displays the image shown in FIG. 10. Therefore, when the viewer sees the image only in the view range of pixel group A or the image only in the view range of pixel group B, the viewer fails to observe a significant image. The viewer can observe a significant image only when the viewer sees the image in the overlap area of the view ranges.

In the second display mode, no voltage is applied between transparent electrodes 29*a*, 29*b* to bring the lens array device into the inactive state, and the display panel displays the image shown in FIG. 11. The viewer now can observe a significant image in the view range of pixel group A or the view range of pixel group B, and a significant image in the overlap area of the view ranges.

In the display device according to the third example, the display signals and the display modes can be changed by the control system shown in FIG. 13 with liquid crystal controller 35 shown in FIG. 13 functioning as a lens array controller.

4th Example

Figure 17:
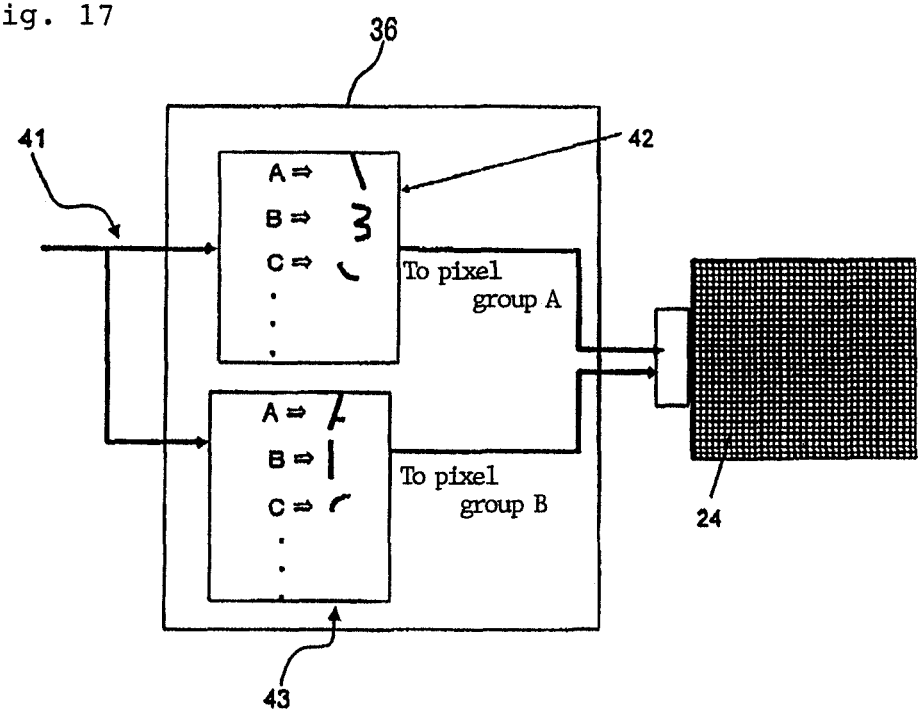
FIG. 17 is a schematic view of a display device according to a fourth example of the present invention.

A display device according to a fourth example of the present invention will be described below with reference to FIG. 17.

The display device according to the fourth example and a control system thereof are identical to those shown in FIG. 13. FIG. 17 shows only details of display controller 36 and display panel 24. In FIG. 17, the display device displays text data.

Operation of display controller 36 in first display controller 36 will first be described below. As shown in FIG. 17, text signal 41 is supplied to display controller 36. Display controller 36 includes pixel group A converter 42 and pixel group B converter 43. Each of pixel group A converter 42 and pixel group B converter 43 has a conversion table for converting the text represented by text signal 41. Pixel group A converter 42 and pixel group B converter 43 convert the characters of the text according to the conversion tables, and send the converted characters to pixel groups A, B. As shown in FIG. 17, the converted characters can be recognized as normal characters only when the converted characters from the conversion tables are combined with each other. Only those characters from one of the conversion tables cannot be recognized as significant characters. In the first display mode, liquid crystal device 32 is turned on to function as the parallax barrier. In the first display mode, therefore, the viewer is unable to recognize significant characters by seeing the displayed characters only in the view range of pixel group A or only in the view range of pixel group B, and can recognize significant characters by only seeing the displayed characters in the overlap area of the view ranges.

In the second display mode, pixel group A converter 42 and pixel group B converter 43 are inactivated. As a result, the characters of the text represented by text signal 41 are not converted, and both pixel groups A, B can display significant text data by themselves. In the second display mode, liquid crystal device 32 is turned off so as not to function as the parallax barrier. Therefore, the viewer can recognize significant characters by seeing the displayed characters in the view range of pixel group A or in the view range of pixel group B, and can also recognize significant characters by seeing the displayed characters in the overlap area of the view ranges.

5th Example

A display device according to a fifth example of the present invention will be described below with reference to FIG. 18.

The display device according to the fifth example and a control system thereof are identical to those shown in FIG. 13. FIG. 18 shows only details of display controller 36 and display panel 24. In FIG. 18, the display device displays images.

Figure 18:
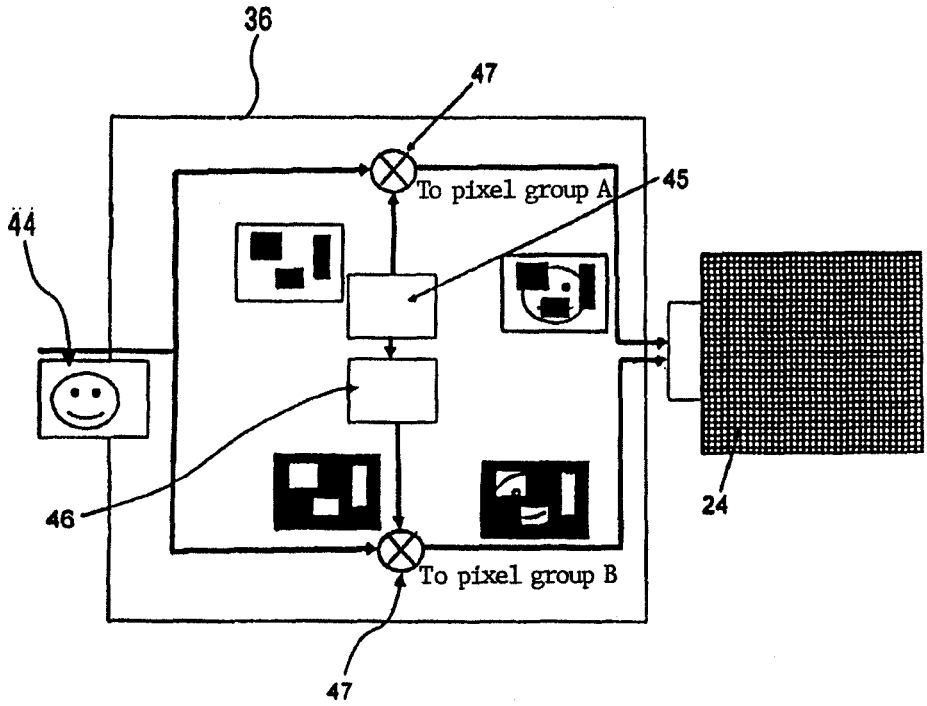
FIG. 18 is a schematic view of a display device according to a fifth example of the present invention.

FIG. 18 illustrates the manner in which display controller 36 operates in the first display mode. In the fifth example, image signal 44 representing an image to be displayed by display panel 24 is sent to display controller 36. Display controller 36 processes image signal 44 as follows: First, random mask generator 45 generates a binary mask image having as many pixels as the number of pixels of the image represented by image signal 44. In FIG. 18, random mask generator 45 generates a binary mask image including a plurality of black boxes in a transparent background (positive image). The size and number of the black boxes can be selected according to an optional probability distribution, and can be adjusted depending on the size of the image to be displayed and the image signal supplied to display controller 36. The mask image generated by random mask generator 45 is inverted into an inverted mask image by image inverter 46. The inverted mask image includes a plurality of transparent boxes in a black background (negative image). Multiplier 47 multiplies the mask image from random mask generator 45 by image signal 44, and sends the product image signal to pixel groups A of display panel 24. Another multiplier 47 multiplies the inverted mask image from image inverter 46 by image signal 44, and sends the product image signal to pixel groups B of display panel 24.

Pixel groups A display an image multiplied by the mask image, and pixel groups B display an image multiplied by the inverted mask image. The viewer is unable to recognize a significant image by seeing the individual images displayed by respective pixel groups A, B, and can recognize a significant image only by seeing the image displayed in the overlap area of the view ranges of pixel groups A, B. Random mask generator 45 can change the mask image every several seconds. As a result, the images displayed by pixel groups A, B are changed every several seconds to prevent the individual images displayed by pixel groups A, B from being recognized by snoopers.

In the second display mode, random mask generator 45 and image inverter 46 stop operating. Therefore, images that are not multiplied by the mask image are displayed by pixel groups A, B. The viewer can observe a significant image even in each of the view ranges of pixel groups A, B.

6th Example

A display device according to a sixth example of the present invention will be described below with reference to FIG. 19.

The display device according to the sixth example and a control system thereof are identical to those shown in FIG. 13. FIG. 19 shows only details of display controller 36 and display panel 24. In FIG. 19, the display device displays images.

Figure 19:
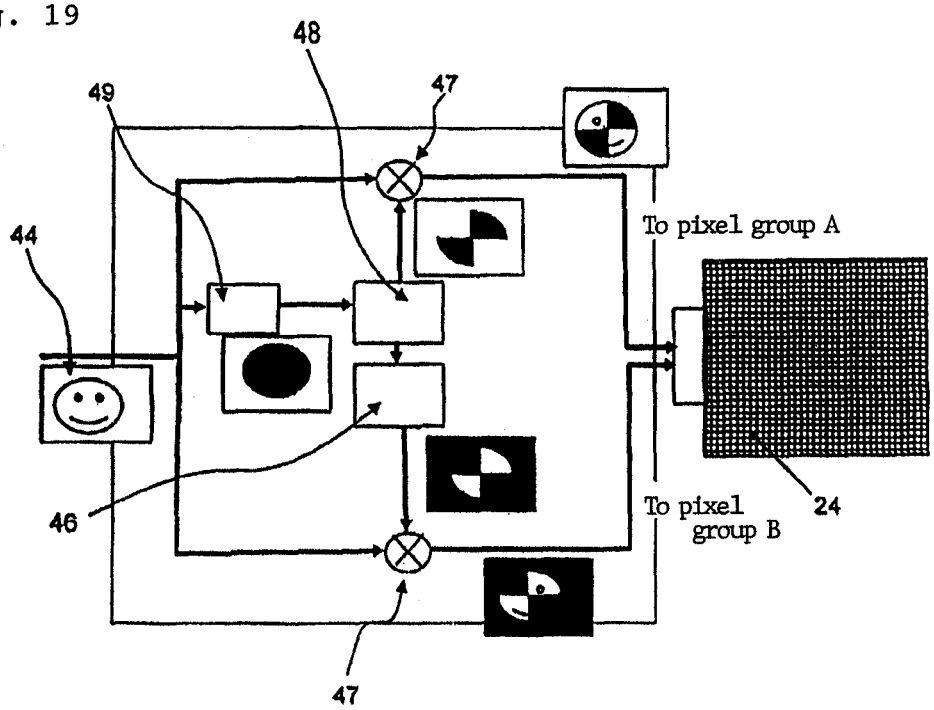
FIG. 19 is a schematic view of a display device according to a sixth example of the present invention.

FIG. 19 illustrates the manner in which display controller 36 operates in the first display mode. In the sixth example, image signal 44 to be sent to pixel groups A is multiplied by a mask image including a plurality of black boxes in a transparent background, and image signal 44 to be sent to pixel groups B is multiplied by an inverted mask image including a plurality of transparent boxes in a black background, as with the fifth example.

According to the sixth example, the mask image and the inverted mask image are generated as follows: Feature point extractor 49 extracts feature points of the image represented by image signal 44. Feature points can be extracted according to a known process. For example, after the image represented by image signal 44 is binarized, joining points thereof are extracted, and feature groups are determined. The representative size of an image and its position can be known from the feature groups. A maximum one of the extracted feature points is shown in FIG. 19. The image signal representative of the extracted feature point is sent to mask generator 48. Mask generator 48 divides the image of the maximum feature point into four segments, and uses one-half of the four segments as a mask image. Multiplier 47 multiplies the mask image by image signal 44, and sends the product image signal to pixel groups A of display panel 24. The mask image is sent to image inverter 46, which generates an inverted mask representing an inversion of the mask image. Another multiplier 47 multiplies the inverted mask image by image signal 44, and sends the product image signal to pixel groups B of display panel 24. Pixel groups A display an image multiplied by the mask image, and pixel groups B display an image multiplied by the inverted mask image. The viewer is unable to recognize a significant image by seeing the individual images displayed by respective pixel groups A, B, and can recognize a significant image only by seeing the image displayed in the overlap area of the view ranges of pixel groups A, B.

As described above, a mask image and an inverted mask image can be generated depending on the image signal. As with the fifth example, mask generator 48 can change the mask image in every several seconds. If the mask image is changed in every several seconds, then the parameters of feature point extractor 49 and mask generator 48 are changed at certain intervals of time.

In the second display mode, mask generator 48 and image inverter 46 stop operating as with the fifth example, and only image signal 44 is sent to pixel groups A, B. The viewer can observe a significant image even in each of the view ranges of pixel groups A, B.

The above processing sequence can be performed by dedicated hardware provided in display controller 36 or by suitable software installed in the processing unit of display controller 36.

What is claimed is:

1. A display device comprising:

a display panel including a plurality of pixel groups which display respective images independently of each other, wherein each one of the pixel groups includes a plurality of pixels, and a parallax barrier with an array of repetitively arranged light-impermeable strips which limit view ranges of images displayed respectively by said pixel groups, wherein each one of the view ranges corresponds to a respective pixel group and comprises:

an overlap area, in which the respective one of the view ranges overlaps with another one of the view ranges; and a non-overlap area, in which the respective one of the view ranges does not overlap with the another one of the view ranges;

wherein said display device is selectively operable in:

a first display mode in which a significant image is recognizable when images displayed respectively by said pixel groups are simultaneously observed in said overlap area, and in which a significant image is unrecognizable when the images displayed respectively by said pixel groups are observed individually in the view ranges except for said overlap area, respectively, wherein each of said pixel groups displays one of a plurality of image segments produced by dividing the significant image by the number of said pixel groups, and the significant image is recognizable upon combination of all the plurality of image segments in said overlap area; and a second display mode in which a significant image is recognizable both when the images displayed respectively by said pixel groups are simultaneously observed in said overlap area and when the images displayed respectively by said pixel groups are observed individually in the view ranges except for said overlap area, respectively, by changing display signals which are supplied to each pixel group, the display signals representing the images to be displayed by each pixel group.

2. The display device according to claim 1, wherein said display device switches between said first display mode and said second display mode by changing the images displayed respectively by said pixel groups.

3. The display device according to claim 2, wherein in said second display mode, each of said pixel groups of said display panel displays the image to be displayed, in its entirety, on said display panel.

4. The display device according to claim 2, wherein said pixel groups of said display panel are divided into a first pixel group and a second pixel group, and wherein in said first display mode, said first pixel group displays an image produced by multiplying the image to be displayed on said display panel by a mask image including a plurality of black boxes in a transparent background, and said second pixel group displays an image produced by multiplying image to be displayed on said display panel by an inverted mask image representing an inversion of the black boxes and the transparent background of said mask image, and in said second display mode, each of said pixel groups of said display panel displays only the image to be displayed on said display panel.

5. The display device according to claim 1, wherein said parallax barrier is switchable between an active state in which said parallax barrier limits the view ranges of the images displayed respectively by said pixel groups such that the view ranges overlap each other in the overlap area, and an inactive state in which said parallax barrier does not limit the view ranges of the images displayed respectively by said pixel groups, and wherein said parallax barrier is in said active state when said display device is in said first display mode, and said parallax barrier is in said inactive state when said display device is in said second display mode.

6. The display device according to claim 1, wherein said parallax barrier comprises an alternate array of light-impermeable units and light-permeable units arranged in a repetitive pattern in one direction or two directions transverse to each other.

7. The display device according to claim 6, wherein said parallax barrier comprises a liquid crystal device which selectively activates and deactivates said light-impermeable units.

8. An electronic device comprising a display device according to claim 1.

9. A display device comprising:

a display panel including a plurality of pixel groups which display respective images independently of each other, wherein each one of the pixel groups includes a plurality of pixels, and a lens array with an array of repetitively arranged lenses which limit view ranges of images displayed respectively by said pixel groups, wherein each one of the view ranges corresponds to a respective pixel group and comprises:

an overlap area, in which the respective one of the view ranges overlaps with another one of the view ranges; and a non-overlap area, in which the respective one of the view ranges does not overlap with the another one of the view ranges;

wherein said display device is selectively operable in:

a first display mode in which a significant image is recognizable when images displayed respectively by said pixel groups are simultaneously observed in said overlap area, and in which a significant image is unrecognizable when the images displayed respectively by said pixel groups are observed individually in the view ranges except for said overlap area, respectively, wherein each of said pixel groups displays one of a plurality of image segments produced by dividing the significant image by the number of said pixel groups, and the significant image is recognizable upon combination of all the plurality of image segments in said overlap area; and a second display mode in which a significant image is recognizable both when the images displayed respectively by said pixel groups are simultaneously observed in said overlap area and when the images displayed respectively by said pixel groups are observed individually in the view ranges except for said overlap area, respectively, by changing display signals which are supplied to each pixel group, the display signals representing the images to be displayed by each pixel group.

10. The display device according to claim 9, wherein said display device switches between said first display mode and said second display mode by changing the images displayed respectively by said pixel groups.

11. The display device according to claim 10, wherein in said second display mode, each of said pixel groups of said display panel displays the im-age, in its entirety, to be displayed on said display panel.

12. The display device according to claim 10, wherein said pixel groups of said display panel are divided into a first pixel group and a second pixel group, and wherein in said first display mode, said first pixel group displays an image produced by multiplying the image to be displayed on said display panel by a mask image including a plurality of black boxes in a transparent background, and said second pixel group displays an image produced by multiplying image to be displayed on said display panel by an inverted mask image representing an inversion of the black boxes and the transparent background of said mask image, and in said second display mode, each of said pixel groups of said display panel displays only the image to be displayed on said display panel.

13. The display device according to claim 9, wherein said lens array is switchable between an active state in which said lens array limits the view ranges of the images displayed respectively by said pixel groups such that the view ranges overlap each other in the overlap area, and an inactive state in which said lens array does not limit the view ranges of the images displayed respectively by said pixel groups, and wherein said lens array is in said active state when said display device is in said first display mode, and said lens array is in said inactive state when said display device is in said second display mode.

14. The display device according to claim 9, wherein said lens array comprises a plurality of lens units arranged in a repetitive pattern in one direction or two directions transverse to each other.

15. The display device according to claim 14, wherein said pixel groups of said display panel are divided into an alternate array of first and second pixel groups;

each of said lens units is associated with pixels of said first pixel groups and pixels of said second pixel group which are disposed adjacent to said pixels of said first pixel groups;

each of said lens units is divided in two by a central line, thereby forming a first side and a second side of each of said lens units;

most of said pixels of said first pixel groups are disposed on the first side of each of said lens units;

most of said pixels of said second pixel groups are disposed on the second side of each of said lens units;

some of said pixels of said second pixel groups are located on said first side of each of said lens units; and some of said pixels of said first pixel group are located on the second side of each of said lens units.

16. An electronic device comprising a display device according to claim 9.

17. A display device comprising:

a display panel including a plurality of pixel groups which display respective images independently of each other, wherein each one of the pixel groups includes a plurality of pixels, and a multiple viewpoint activator which limits view ranges of images displayed respectively by said pixel groups, wherein each one of the view ranges corresponds to a respective pixel group and comprises:

an overlap area, in which the respective one of the view ranges overlaps with another one of the view ranges; and a non-overlap area, in which the respective one of the view ranges does not overlap with the another one of the view ranges;

wherein said display device is selectively operable in:

a first display mode in which a significant image is recognizable when images displayed respectively by said pixel groups are simultaneously observed in said overlap area, and in which a significant image is unrecognizable when the images displayed respectively by said pixel groups are observed individually in the view ranges except for said overlap area, respectively, wherein each of said pixel groups displays one of a plurality of image segments produced by dividing the significant image by the number of said pixel groups, and the significant image is recognizable upon combination of all the plurality of image segments in said overlap area; and a second display mode in which a significant image is recognizable both when the images displayed respectively by said pixel groups are simultaneously observed in said overlap area and when the images displayed respectively by said pixel groups are observed individually in the view ranges except for said overlap area, respectively, by changing display signals which are supplied to each pixel group, the display signals representing the images to be displayed by each pixel group.

* * * * *